US010538080B2

(12) United States Patent
Adler et al.

(10) Patent No.: US 10,538,080 B2
(45) Date of Patent: Jan. 21, 2020

(54) DEVICE FOR PRODUCING COLLECTIONS OF SHEET-LIKE PRINTED PRODUCTS AND FOLDING APPARATUS

(71) Applicant: Kolbus GmbH & Co. KG, Rahden (DE)

(72) Inventors: Michael Adler, Bitterfeld-Wolfen (DE); Ronald Drabe, Leipzig (DE); Jens Winter, Leipzig (DE)

(73) Assignee: Kolbus GmbH & Co. KG, Rahden (DE)

( * ) Notice: Subject to any disclaimer, the term of this patent is extended or adjusted under 35 U.S.C. 154(b) by 96 days.

(21) Appl. No.: 15/963,401

(22) Filed: Apr. 26, 2018

(65) Prior Publication Data

US 2018/0319157 A1 Nov. 8, 2018

(30) Foreign Application Priority Data

May 5, 2017 (DE) ..... 10 2017 004 370

(51) Int. Cl.
*B41F 33/00* (2006.01)
*B41F 19/00* (2006.01)
*B41F 21/00* (2006.01)

(52) U.S. Cl.
CPC ..... *B41F 33/0081* (2013.01); *B41F 19/008* (2013.01); *B41F 21/00* (2013.01)

(58) Field of Classification Search
CPC ..... B41F 33/0081
USPC ..... 101/481
See application file for complete search history.

(56) References Cited

U.S. PATENT DOCUMENTS 4,716,833 A * 1/1988 Regalbuto ..... E21B 43/117 102/307
4,754,959 A * 7/1988 Kobler ..... B41F 13/54 270/21.1
5,692,440 A * 12/1997 Hillebrand ..... B26D 1/626 101/224
8,893,615 B2 * 11/2014 Crozier ..... B41F 13/02 101/226
2003/0096688 A1 5/2003 Lange
2003/0106405 A1 * 6/2003 Hartmann ..... B65H 29/56 83/155
2014/0183808 A1 7/2014 Egli et al.
2015/0239234 A1 * 8/2015 Regelsberger ..... B41F 33/0036 101/481

FOREIGN PATENT DOCUMENTS

EP 0257390 A1 3/1988
WO 2014131474 A1 9/2014

OTHER PUBLICATIONS

Kersten, Dr. Peter, German Search Report, May 5, 2017, Application No. 10 2017 004 370.1.

* cited by examiner

*Primary Examiner* — Anthony H Nguyen
(74) *Attorney, Agent, or Firm* — Alix, Yale & Ristas, LLP

(57) ABSTRACT

The invention pertains to a device for producing collections of sheet-like printed products from a supplied material strand, in which a switch feeds the product stream to a receiving cylinder via one of at least two collecting cylinders, as well as to a folding apparatus with such a collecting device.

11 Claims, 3 Drawing Sheets

DEVICE FOR PRODUCING COLLECTIONS OF SHEET-LIKE PRINTED PRODUCTS AND FOLDING APPARATUS

BACKGROUND

The present invention pertains to a device for producing collections of sheet-like printed products, as well as to a folding apparatus.

EP 0 257 390 A1 discloses a folding apparatus that produces multi-sheet folded collections of a supplied paper web. The folding apparatus comprises a first longitudinal folding device, by means of which the supplied web is centrally folded along its length and fed to a cross-cutting device. This cross-cutting device separates corresponding folded sections from the folded web. The cross-cutting device features a cutting cylinder that extends across the folded paper web and cooperates with a grooved cylinder. The cutting cylinder contains two knife receptacles that are offset relative to one another by 180° and can be selectively fitted with a knife. It is therefore possible to selectively produce two different cut-off lengths, which respectively correspond to the full circumference and half the circumference of the cutting cylinder, depending on the knife fitting.

A cross-folding device is arranged downstream of this cross-cutting device, wherein the collecting cylinder of said cross-folding device cooperates with at least one folding jaw cylinder. To this end, the collecting cylinder is equipped with two sets of grippers that are arranged on mutually adjustable armature carriers. The collecting cylinder receives the sections arriving from the cross-cutting device with these grippers and releases them to the folding cylinder. To this end, the grippers are actuated by means of a cam drive. The grippers of the collecting cylinder have to be respectively adjusted to the product thickness in order to process collections of different thickness. This leads to a significant set-up effort.

In order to eliminate this disadvantage, DE 101 56 706 A1 proposes a collecting cylinder that is equipped with holding elements in the form of puncture elements rather than grippers. The controllable puncture elements are formed by sets of needles. The needles protrude over the circumference of the collecting cylinder for transporting and collecting the products such that they can be pinned thereon. The puncture elements are retracted in order to fold and forward the products. In this case, the motion of the puncture elements is not dependent on the product thickness such that the variability of such a folding apparatus with respect to the product thickness is significantly improved.

Regardless of the holding system used, these folding apparatuses have the disadvantage that the section length is defined by the diameter and the knife fitting of the cutting cylinder. A change of the knife fitting is labor-intensive and requires a production downtime. A digital web-fed printing press equipped with such a folding apparatus is therefore restricted to a few formats with respect to the section length. The utilization of servomotors in fact makes it possible to eliminate the disadvantage of such a format restriction.

Due to the principle involved, a change from a continuous material transport, which is characterized by a constant web speed, to a cyclic transport of the separated sections with a constant cycle speed takes place. The production of highly different product lengths therefore requires such high dynamics of the different cylinder motions that they cannot be economically realized. An attempt to solve this problem by restricting the potential format range dramatically reduces the variability of the digital printing press.

SUMMARY OF THE INVENTION

The invention is therefore based on the objective of developing a device of the initially cited type, which does not have the above-described disadvantages and allows a high variability with respect to the product formats with little set-up effort.

According to the invention, the above-defined objective is attained with the characteristic features of the characterizing portion of claim 1, as well as a corresponding folding apparatus with the characteristic features of the characterizing portion of claim 10. Advantageous enhancements are disclosed in the dependent claims.

A device for producing collections of sheet-like printed products of a supplied material strand comprises a first transport device that feeds the material strand to a cross-cutting device. The material strand is formed of an individually printed paper web. However, it may also consist of multiple webs or partial webs that lie on top of one another. In this case, the transport direction corresponds to the longitudinal direction of the strand. The cross-cutting device arranged downstream of this first transport device separates sections from the supplied strand by cutting the strand transverse to the transport direction. Depending on the composition of the supplied strands, the cross-cutting device thereby forms successive sections or section batches. Sections or section batches of different lengths can be produced by adapting the timing of the supply of the strand by the first transport device to the cutting process carried out by the cross-cutting device.

The cross-cutting device advantageously comprises a cutting cylinder that is oriented transverse to the transport direction. In this way, a high production capacity can be achieved in the production of various formats with a simple and compact design.

According to the invention, a first collecting cylinder and a second collecting cylinder follow the cross-cutting device in the transport direction of the printed products. The transport path of the printed products selectively leads either to the first collecting cylinder or to the second collecting cylinder. To this end, a controllable switch is provided upstream of the collecting cylinders and defines the transport path accordingly. In this way, sections or section batches produced by the cross-cutting device can be individually fed to one of the two respective collecting cylinders without production downtime.

Conventional collecting cylinders respectively feature at least one fixing device on their circumference. These fixing devices serve for holding the supplied sections or section batches on the circumference of the respective collecting cylinder and for feeding them to the receiving cylinder, which is arranged downstream of the collecting cylinder in the transport direction, due to the rotation of the collecting cylinder. A collecting process takes place during multiple revolutions of the collecting cylinder prior to the transfer to the receiving cylinder. In this context, it is irrelevant whether the fixing devices of the aforementioned cylinders are equipped with grippers, needles or other holding elements.

In conjunction with the switch, different diameters of the first collecting cylinder and the second collecting cylinder make it possible to feed the respective section or section batch to the collecting cylinder, the diameter of which matches the section length best.

The required adaptation of the speed of the collecting cylinder to the section length is thereby significantly reduced. In comparison with a device with only one collecting cylinder, which is necessarily adapted to the largest format to be processed, it is thereby possible to achieve a significantly broader format range with the same production capacity. Alternatively, the production capacity in the processing of short sections can be significantly increased with the same format range as in known devices.

The collecting cylinders transfer the sections or section batches to a receiving cylinder arranged downstream thereof. This receiving cylinder features fixing devices on its circumference similar to the collecting cylinders. In this way, the receiving cylinder can be used for collecting processes other than merely transporting away the sections or section batches. Both collecting cylinders advantageously feed a common receiving cylinder. On the one hand, a compact design of the device can thereby be realized. On the other hand, this arrangement allows different combinations of the individual collecting processes carried out by the different cylinders such that a high variability of the device is achieved.

The variability with respect to the processable format sequences and collecting schemes of the device is additionally increased in that the receiving cylinder comprises two sets of fixing devices, which are respectively assigned to one of the upstream collecting cylinders. Each set consists of a fixing device or multiple fixing devices that are uniformly distributed over the circumference of the receiving cylinder. The distance between the fixing devices of one set about the circumference of the receiving cylinder forms its pitch. The respective assignment of a set of fixing devices of the receiving cylinder to a set of fixing devices of the collecting cylinder allows an optimized design of the set with respect to this collecting cylinder.

It is particularly advantageous if the diameter of the respective collecting cylinder corresponds to an integral multiple of the associated pitch of the receiving cylinder, wherein the multiple may also be 1. In this way, the optimization of the motion sequences of the collecting cylinders and the receiving cylinder with their fixing devices can be realized in a particularly simple fashion. A particularly high variability of the device is achieved if the pitch of the first set of fixing devices corresponds to a non-integral multiple of the pitch of the second set of fixing devices.

The sets of fixing devices of the receiving cylinder are advantageously designed in such a way that a common fixing device is assigned to both sets. In this way, the required diameter of the receiving cylinder and the complexity of the device are reduced with the same application spectrum.

An opposite rotating direction of the collecting cylinders allows a particularly compact arrangement of the collecting cylinders and the receiving cylinder relative to one another. In this case, the rotating direction of the receiving cylinder is always chosen in such a way that the collecting cylinder supplying the material and the receiving cylinder transporting away the material rotate in opposite directions such that a reliable transfer of the products can take place.

The device can be used in a particularly versatile fashion if at least the cross-cutting device is provided with an individual drive such that different length formats can be produced. It is hereby expressly noted that the number of collecting cylinders and associated sets of fixing devices of the receiving cylinder is not limited to two, but may also be higher.

The described collecting device may form part of a folding apparatus. This folding apparatus also comprises a reel unwinding system, which unwinds the reel of printed material into a web. A longitudinal cutting device cuts this web into multiple partial webs, which are conventionally guided on top of one another so as to form a strand by means of turning bars in a downstream guiding device. This strand is fed to the collecting device with a cross-cutting device of the above-described type. A folding device is arranged downstream of the collecting device and conventionally folds the collections supplied by the collecting device in accordance with the knife folding principle.

BRIEF DESCRIPTION OF THE DRAWINGS

Exemplary embodiments of the invention are described below with reference to the figures, to which we hereby refer with respect to all details not specifically mentioned in the description. These examples do not represent an exhaustive description of the invention. In the schematic figures.

DETAILED DESCRIPTION

Figure 1:
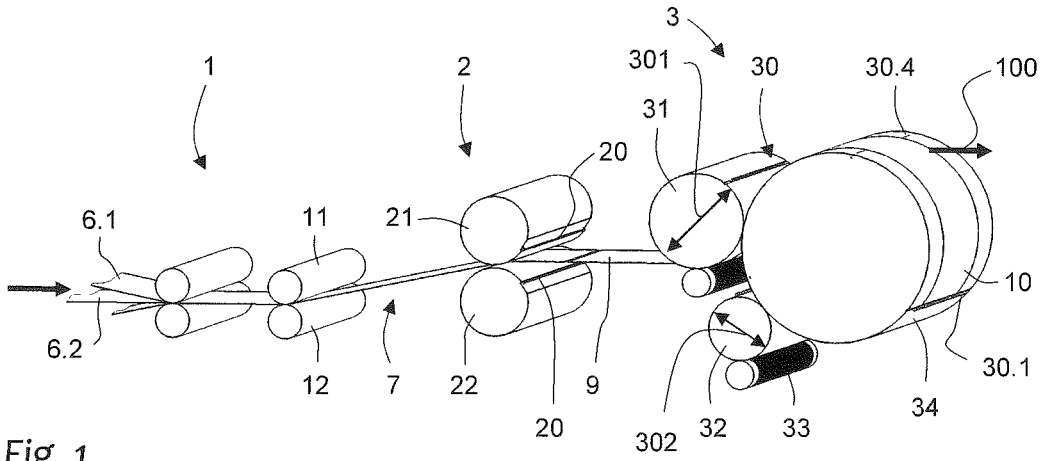
FIG. 1 shows a collecting device in a configuration for long products.
Figure 2:
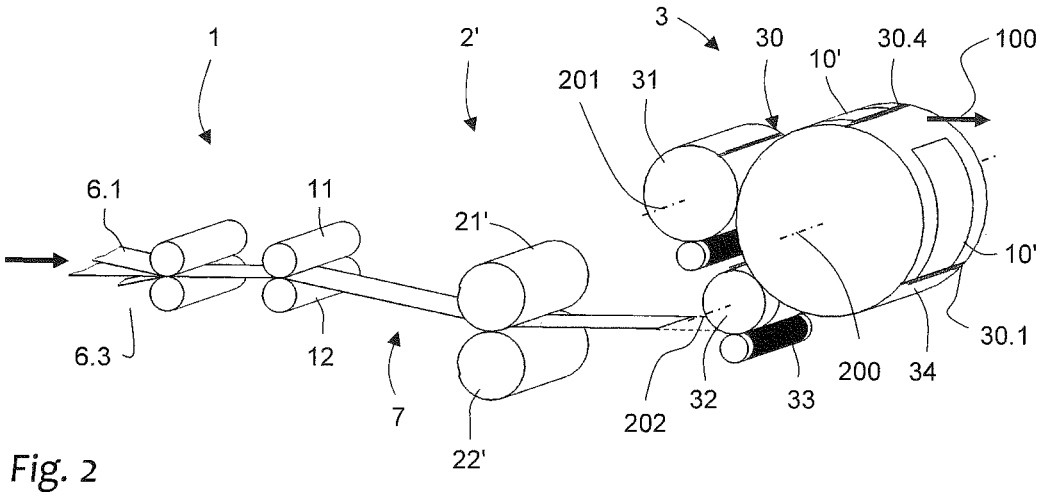
FIG. 2 shows a collecting device in a configuration for short products.

The collecting device is illustrated in a configuration for long products 10 in FIG. 1 and in a configuration for short products 10' in FIG. 2. If not indicated otherwise, the explanations with reference to FIG. 1 apply analogously to FIG. 2.

Figure 3:
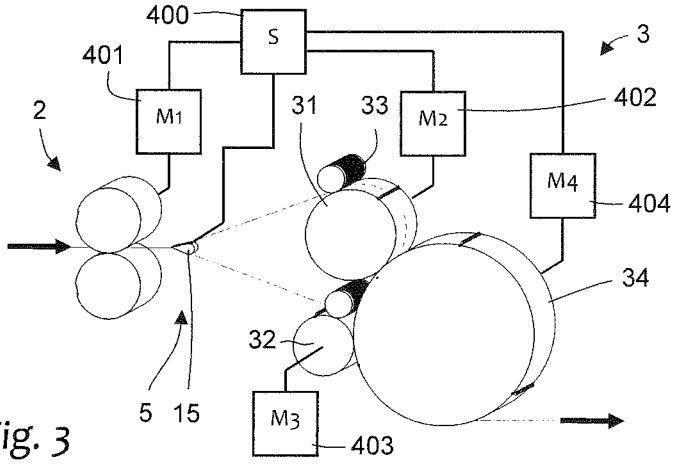
FIG. 3 shows a collecting device.

The web-shaped strand 7, which conventionally consists of multiple partial webs 6.1, 6.2, 6.3, is fed to the device by a feeder 1. This strand 7 is guided through pairs of rollers that are respectively composed of an upper roller 11 and a lower roller 12 and serve for guiding and transporting the strand 7. The feeder 1 feeds the strand 7 to a cross-cutting device 2 that separates section batches 9 of finite length therefrom. The cross-cutting device 2 consists of an upper cutting cylinder 21 that cooperates with a lower cutting cylinder 22. These cutting cylinders 21, 22 transversely extend over the entire width of the strand 7 to be cut. They are respectively fitted with a linear knife 20. The cutting cylinders 21, 22 are connected to and driven by a controllable drive 401 as illustrated in FIG. 3. Sections 9 of different lengths can be produced without set-up effort by varying the speed of these cutting cylinders relative to the transport speed of the supplied strand 7.

As an alternative to the illustrations in the figures, the cross-cutting device 2 may also consist of a cutting cylinder that cooperates with a grooved cylinder. It is also possible to angle the cutting cylinder relative to the transport direction 100 and to equip the cutting cylinder with a helical knife such that the cut progresses from one edge of the strand 7 to the opposite edge over the width of the strand 7.

In the first position of the cross-cutting device 2 illustrated in FIG. 1, the section batches 9 separated from the supplied strand 7 are fed to a first collecting cylinder 31. This collecting cylinder is arranged such that it is rotatable about its axis transverse to the transport direction 100 and features a fixing device 30 on its circumference.

This fixing device 30 is conventionally designed for taking hold of and effectively transporting the supplied section batch 9, as well as for releasing this section batch during the transfer to the downstream receiving cylinder 34. As an example, a fixing device 30 in the form of a highly simplified puncture element system is illustrated in the figures. This puncture element system is realized in a controllable fashion such that its needles protrude outward over the circumference of the first collecting cylinder 31 in an active state and are retracted from its circumference in a passive state. As long as the fixing device 30 is activated, it collects individually supplied section batches 9 into a partial collection 10 in the form of a stack, which grows on the circumference of the first collecting cylinder 31 with each revolution of the first collecting cylinder 31.

A mating roller 33 is arranged in the receiving point of the first collecting cylinder 31 and cooperates with the fixing device 30 in such a way that the supplied section batch 9 is reliably received by the first collecting cylinder 31. Once the fixing device 30 is switched into the passive state in the transfer point to the receiving cylinder 34, the first collecting cylinder 31 transfers this partial collection 10 to the receiving cylinder 34.

In the alternative position of the cross-cutting device 2' illustrated in FIG. 2, this cross-cutting device feeds the separated section batches 9 to a second collecting cylinder 32 rather than to the first collecting cylinder 31. These collecting cylinders 31, 32 are arranged parallel to one another. They are designed identically and essentially differ with respect to their diameters 301, 302 and therefore the maximum processable length of the supplied section batches 9. The second collecting cylinder 32 cooperates with the same receiving cylinder 34 as the first collecting cylinder 31. The cross-cutting device 2, 2' represents a switch and feeds the section batches 9 to one of multiple collecting cylinders 31, 32 whereas the receiving cylinder 34 once again combines these different transport paths into a common transport path.

The receiving cylinder 34 is arranged parallel to the collecting cylinders 31, 32 and has a significantly larger diameter than these collecting cylinders. Multiple fixing devices 30.1, 30.2, 30.3, 30.4 are arranged on its circumference and spaced apart from one another in the circumferential direction. With respect to their function and design, these fixing devices correspond to the fixing devices 30 of the collecting cylinders. The fixing devices 30.1, 30.2, 30.3, 3.4 of the receiving cylinder can be combined into multiple sets, wherein one set of fixing devices 30.1, 30.2, 30.3, 30.4 is respectively assigned to each of the collecting cylinders 31, 32 that supply the receiving cylinder 34. In this case, a first set comprises the fixing devices 30.1 and 30.3, which are arranged opposite of one another on the circumference of the receiving cylinder 34 and assigned to the first collecting cylinder 31.

Figure 4:
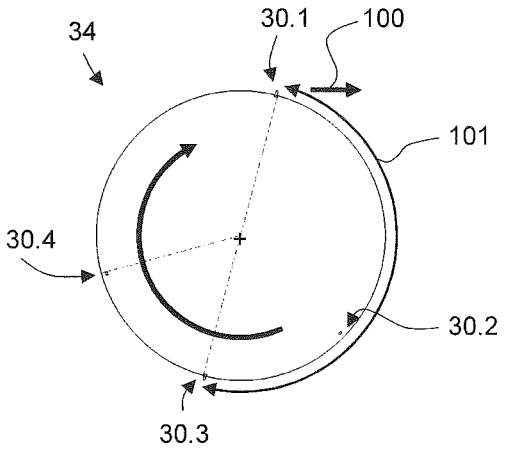
FIG. 4 shows a receiving cylinder in a configuration for long products.
Figure 5:
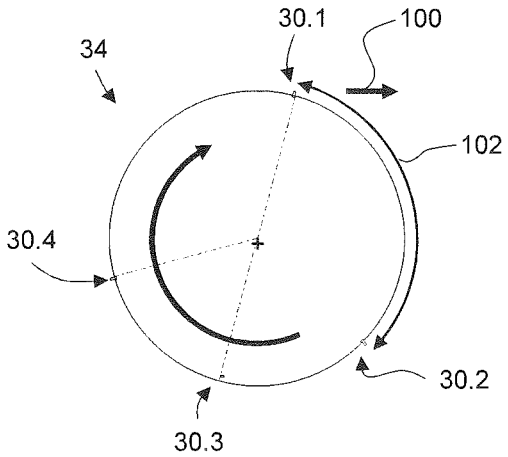
FIG. 5 shows a receiving cylinder in a configuration for short products.

When the first collecting cylinder 31 is supplied by the cross-cutting device 2, this first set of fixing devices 30.1, 30.3 of the receiving cylinder 34 is activated as shown in FIG. 4. The remaining fixing devices 30.2, 30.4, which are not assigned to the first collecting cylinder 31, remain in the passive state. However, when the second collecting cylinder 32 is supplied by the cross-cutting device 2', the assigned second set of fixing devices 30.1, 30.2, 30.4 is activated whereas the fixing device 30.3, which is not assigned to the second collecting cylinder 32, remains in the passive state as shown in FIG. 5.

The section length 101, 102 between two adjacent fixing devices 30.1, 30.2, 30.3, 30.4 of the same set corresponds to the circumference of the assigned collecting cylinder 31, 32. This makes it possible to maintain identical circumferential speeds of the collecting cylinders 31, 32 and the receiving cylinder 34 and to mechanically couple their drives.

The receiving cylinder 34 is also suitable, in principle, for collecting printed products on each of its of fixing devices 30.1, 30.2, 30.3, 30.4 as described above with reference to the first collecting cylinder 31. The interaction between a collecting process into partial collections 10, 10', which selectively takes place on one of multiple collecting cylinders 31, 32, and a subsequent additional collecting process into collections 16 on the receiving cylinder 34 allows a very broad variety of collecting schemes. Consequently, the collecting device can be used in a very versatile fashion with respect to a given sequence of printed images on the supplied strand 7.

In the alternative embodiment illustrated in FIG. 3, a switch 5 is arranged downstream of the stationary cross-cutting device 2. This switch 5 selectively feeds the respective section batch 9 to one of the collecting cylinders 31, 32 with the aid of an adjustable guide element 15. The switch 5 is connected to the control 400 of the device in order to control the adjustment of the guide element 15. The cross-cutting device 2, as well as the collecting cylinders 31, 32 and the receiving cylinder 34, respectively feature an individual drive that is connected to the same control 400. The rotating direction of the collecting cylinders 31, 32 and the receiving cylinder 34 shown in FIG. 3 are opposite the rotating direction of the collecting cylinders 31, 32 and the receiving cylinder 34 in FIGS. 1 and 2.

Figure 6:
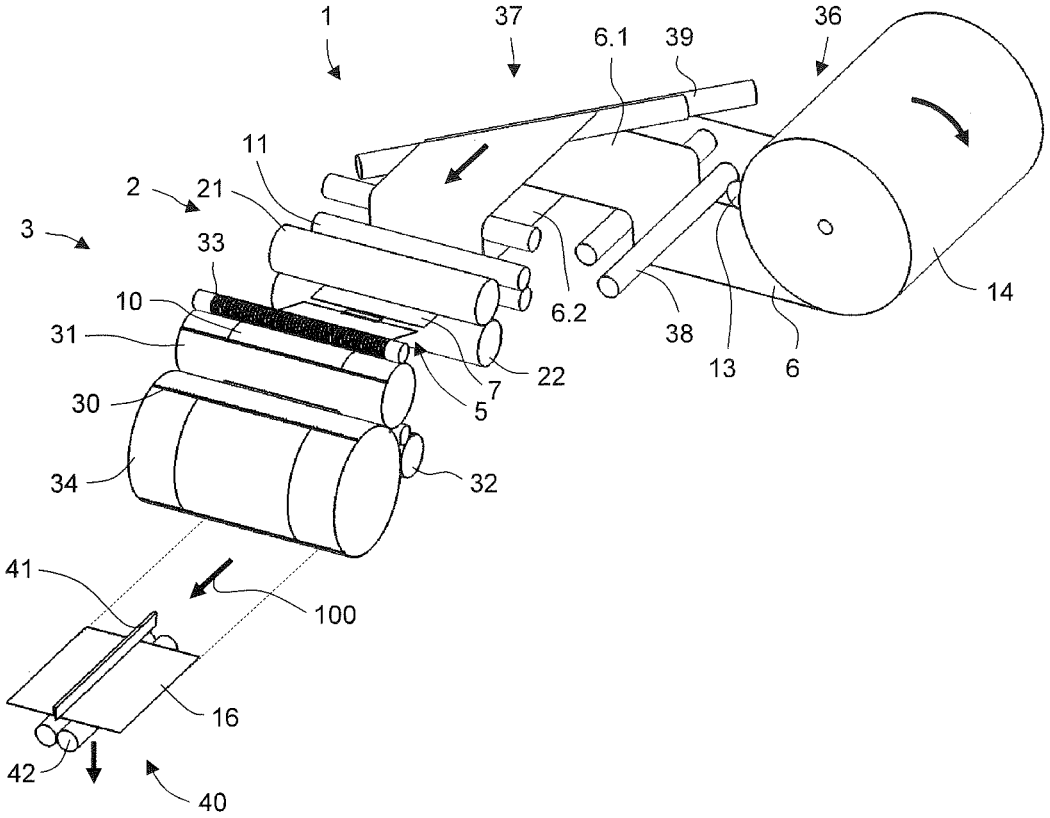
FIG. 6 shows a folding apparatus.

The schematic illustration in FIG. 6 shows a circumferentially variable folding apparatus with a collecting device of the type corresponding to FIG. 3. A longitudinal cutting device 36 separates a paper reel 14 into two parallel partial webs 6.1, 6.2 by means of a pair of circular knives 13 immediately after it is unwound. These partial webs 6.1, 6.2 are placed on top of one another and combined into a strand 7 with the aid of multiple guide rods 38 and turning bars 39 of a guiding device 37.

The thusly formed strand 7 is separated into section batches 9 by a cross-cutting device 2 and subsequently collected into collections 16 in the above-described fashion by the downstream collecting device 3. The collections 16 are fed to the folding device 40 arranged downstream of the collecting device 3 by means of another not-shown transport device. This folding device conventionally operates in accordance with the knife folding principle. The folding knife 41 extends in the transport direction 100 of the supplied collection 16 and is arranged above the feed plane. The folding rollers 42, which cooperate with the folding knife 41, are arranged underneath the feed plane such that the transport direction 100 of the printed product changes from a horizontal direction to a vertical direction. The folded collections 16 are conventionally fed to other not-shown devices.

Figure 7:
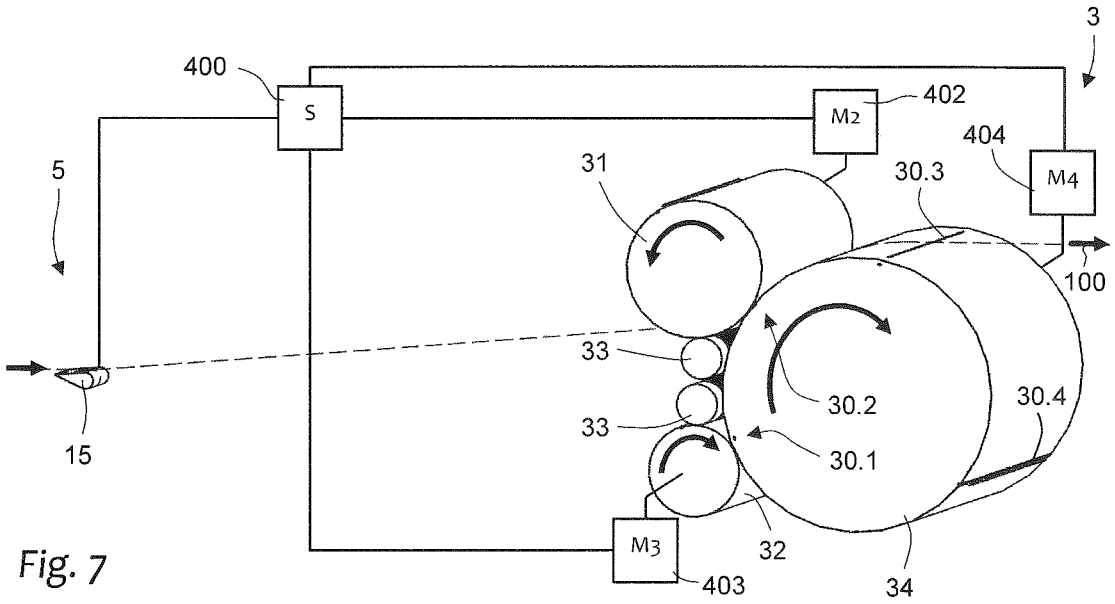
FIG. 7 shows an alternative collecting device with receiving cylinders arranged to rotate in opposite directions, the collecting device is shown directing products to a receiving cylinder and collecting cylinder configured for long products.
Figure 8:
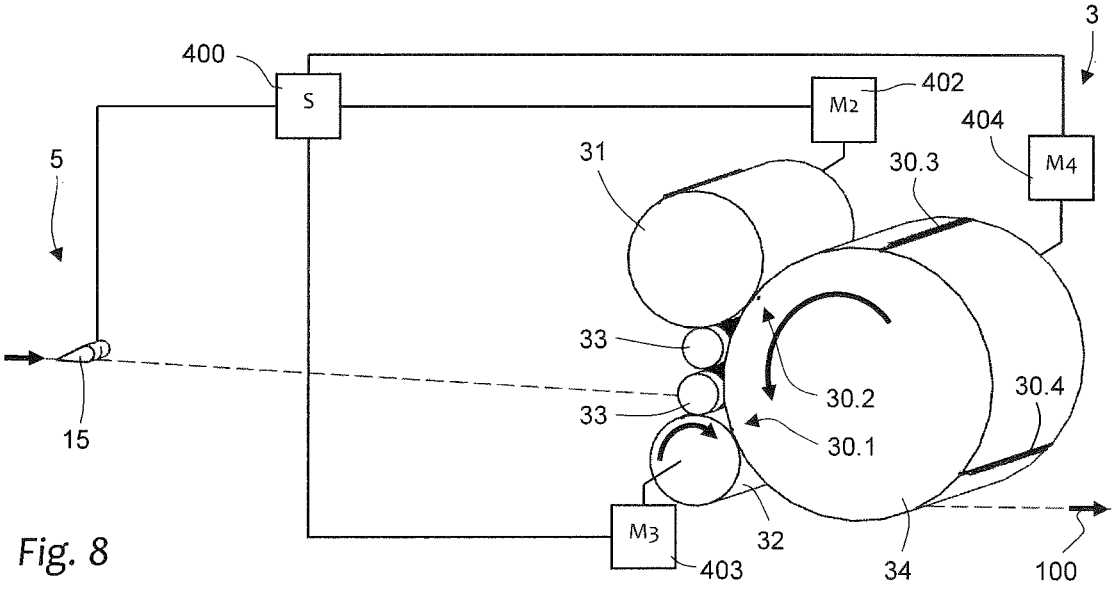
FIG. 8 shows the collecting device of FIG. 7 directing products to a receiving cylinder and collecting cylinder configured for short products.

FIGS. 7 and 8 illustrate a collecting device 3 in which the collecting cylinders 31, 32 are arranged to rotate in opposite directions. In the collecting device 3 of FIGS. 7 and 8, the mating rollers 33 are between the collecting cylinders 31, 32, which results in a compact configuration of the collecting cylinders 31, 32, and the receiving cylinder 34 relative to one another. The configuration of the collecting device 3 of FIGS. 7 and 8 is different from the collecting devices of FIGS. 1-3, in which both of the receiving cylinders 31, 32 rotate in the same direction. In the collecting device 3 of FIGS. 7 and 8, the receiving cylinder 34 is connected to a controllable drive 404, and the direction of rotation of the receiving cylinder 34 is reversible. The receiving cylinder 34 rotates in a first direction when receiving sections or section batches 9 from the first collecting cylinder 31 as shown in FIG. 7. The receiving cylinder 34 rotates in a second direction when receiving sections or section batches 9 from the second collecting cylinder 31 as shown in FIG. 8. The controllable drives 402, 403, and 404 are coordinated by control 400 to match the rotational speed and direction of rotation of the receiving cylinder 34 with the rotational speed and direction of the collecting cylinder 31, 32, from which the receiving cylinder 34 is receiving sections or section batches 9.

FIG. 7 shows the collecting device 3 feeding material to the first collecting cylinder 31, which is configured for long products. A controllable guide 15 is shown in a position to direct material to the first collecting cylinder 31, which is then transferred to the receiving cylinder 34. In FIG. 7, the rotational direction and speed of the receiving cylinder 34 are coordinated with the rotational direction and speed of the first collecting cylinder 31 by control 400. The fixing devices 30.4 on the receiving cylinder 34 that have a pitch compatible with long products received from the first collecting cylinder 31 are shown in an active state, while the fixing devices 30.3 that have a pitch compatible with short products are shown in a passive (retracted) state.

FIG. 8 shows the controllable guide 15 in a position to direct material to the second collecting cylinder 32, which is configured for short products. In FIG. 8, the rotational direction and speed of the receiving cylinder 34 are coordinated with the rotational direction and speed of the second collecting cylinder 32. The fixing devices 30.3 and 30.4 are shown in an active state, forming a set of fixing devices 30.3, 30.4 having a pitch compatible with short products transferred from the second collecting cylinder 32. The direction of rotation of the receiving cylinder 34 in FIG. 8 is opposite the direction of its rotation in FIG. 7.

What is claimed:

1. An apparatus for producing collections (16) of sheet-like printed products from a strand (7) supplied in a transport direction by a transport device (1), the strand (7) having a width and consisting of an individual web (6) or multiple combined webs (6) and/or partial webs (6.1, 6.2, 6.3), said apparatus comprising:

a cross-cutting device (2, 2') downstream of the first transport device (1) in the transport direction (100), said cross-cutting device (2, 2') separating successive sections and/or section batches (9, 9') from the strand (7);

a first collecting cylinder (31) rotatable about a first rotational axis (201), said first collecting cylinder (31) having a first diameter (301), an outer surface and at least one fixing device (30) on said outer surface, said fixing device (30) adapted to hold a section and/or section batch (9, 9') received from the cross-cutting device (2, 2') on said outer surface;

a second collecting cylinder (32) rotatable about a second rotational axis (202) parallel with said first rotational axis (201), said second collecting cylinder (32) having a second diameter (302), an outer surface and at least one fixing device (30) adapted to hold a section and/or section batch (9, 9') received from the cross cutting device (2, 2') on said outer surface;

a receiving cylinder (34) downstream from said first and second collecting cylinders (31, 32) in the transport direction (100) and rotatable about a third rotational axis (200) parallel with said first rotational axis (201) and said second rotational axis (202), said receiving cylinder (34) having an outer surface and multiple fixing devices (30.1, 30.2, 30.3, 30.4) adapted to hold sections and/or section batches (9, 9') transferred from said first collecting cylinder (31) or said second collecting cylinder (32) on said outer surface; and a controllable switch (5) that is arranged downstream of the cutting device (2, 2') and upstream of the first and second collecting cylinders (31, 32) in the transport direction (100), said controllable switch (5) selectively feeds the sections and/or section batches (9, 9') to the first collecting cylinder (31) or the second collecting cylinder (32).

2. The apparatus of claim 1, wherein said receiving cylinder (34) includes at least first set of fixing devices (30.1, 30.3) and a second set of fixing devices (30.1, 30.2, 30.4), each set of fixing devices (30.1, 30.3) (30.1, 30.2, 30.4) being uniformly distributed about a circumference of said receiving cylinder (34), a first distance between the fixing devices (30.1, 30.3) of the first set defining a first pitch (101) and a second distance between the fixing devices of the second set (30.2, 30.4) defining a second pitch (102).

3. The apparatus of claim 2, wherein the first pitch (101) corresponds to a non-integral multiple of the second pitch (102).

4. The apparatus of claim 2, wherein at least one fixing device (30.1) is assigned to both said first set of fixing devices (30.1, 30.3) and said second set of fixing devices (30.1, 30.2, 30.4).

5. The apparatus of claim 2, wherein said first diameter (301) corresponds to an integral multiple of said first pitch (101) and said second diameter (302) corresponds to an integral multiple of said second pitch (102).

6. The apparatus of claim 1, wherein said first collecting cylinder (31) rotates in a first direction, and said second collecting cylinder (32) rotates in a second direction opposite said first direction, and said receiving cylinder (34) is controllable to rotate in either said first direction or in said second direction.

7. The apparatus of claim 1, wherein said cross-cutting device (2, 2') is driven by a controllable drive (401) and adapted to separate sections and/or section batches (9, 9') of different length from the strand (7).

8. The apparatus of claim 1, wherein said cross-cutting device (2, 2') includes at least one cutting cylinder (21, 21', 22, 22') that extends at least over the width of the strand (7).

9. The apparatus of claim 7, comprising a controller (400) operatively connected to said controllable switch (5) and the controllable drive (401) of the cross-cutting device (2. 2'), said controller determining a length of said sections and/or section batches (9, 9') separated from the strand (7) and operating said controllable switch (5) to direct said sections and/or section batches (9, 9') to either said first collecting cylinder 31 or said second collecting cylinder (32).

10. The apparatus of claim 9, wherein said first diameter (301) is greater than said second diameter (302) and said controller (400) operates said controllable switch (5) to direct sections and/or section batches (9, 9') to either said first collecting cylinder (31) or said second collecting cylinder (32) based on the length of the sections and/or section batches (9, 9') separated from the strand (7).

11. The apparatus of claim 1, comprising:

a folding device (40) downstream of the receiving cylinder (34) in the transport direction (100), said folding device at least one folding knife (41) and a pair of folding rollers (42) downstream from the folding knife (41) in the transport direction (100), said folding device (40) folding sections and/or section batches (9, 9') received from said receiving cylinder (34).

* * * * *